United States Patent [19]

Akman

[11] 3,949,148

[45] Apr. 6, 1976

[54] TRANSPARENCY FOR MULTI-COLOR ELECTROSTATIC COPYING

[75] Inventor: Alptekin Akman, Ontario, N.Y.

[73] Assignee: Xerox Corporation, Stamford, Conn.

[22] Filed: Nov. 15, 1973

[21] Appl. No.: 416,341

[52] U.S. Cl. ..... 428/500; 96/1.2; 96/1.4; 427/24; 428/411; 428/412

[51] Int. Cl.[2]. B05D 5/12; G03G 7/00; G03G 13/16

[58] Field of Search ..... 96/1.4, 1.2; 117/138.8 A, 117/100 C; 427/146, 24; 428/412, 411, 500

[56] References Cited

UNITED STATES PATENTS

| | | | |
|---|---|---|---|
| 2,831,783 | 4/1958 | Swiss et al. | 117/138.8 A |
| 3,169,866 | 2/1965 | Lee et al. | 117/138.8 A X |
| 3,169,880 | 2/1965 | Strauss | 117/138.8 A X |
| 3,256,107 | 6/1966 | Strauss | 117/138.8 A X |
| 3,408,216 | 10/1968 | Mott et al. | 96/1.4 |
| 3,493,412 | 2/1970 | Johnston et al. | 96/1.4 X |
| 3,522,072 | 7/1970 | Florence et al. | 117/138.8 A |
| 3,535,112 | 10/1970 | Dolce et al. | 96/1.4 |
| 3,539,340 | 10/1970 | Dolce et al | 96/1.4 |
| 3,539,341 | 10/1970 | Dolce et al. | 96/1.4 |
| 3,560,417 | 2/1971 | Pizzi | 117/138.8 A X |
| 3,597,373 | 8/1971 | Bregoff et al. | 117/138.8 A X |
| 3,664,834 | 5/1972 | Amidon et al. | 96/1.4 |
| 3,716,360 | 2/1973 | Fukushima et al. | 96/1.4 |
| 3,773,551 | 11/1973 | Kiener et al. | 117/138.8 A |
| 3,784,398 | 1/1974 | Metcalfe et al. | 96/1.4 X |
| 3,814,599 | 6/1974 | Cree | 96/1.4 |

FOREIGN PATENTS OR APPLICATIONS

| | | | |
|---|---|---|---|
| 763,390 | 7/1967 | Canada | 117/138.8 A |

OTHER PUBLICATIONS

6413954; Apr., 1965, Netherlands, to General Aniline, 14 pages.

Def. Pub. 662,288; Jan. 1969; United States.

*Primary Examiner*—David Klein

*Assistant Examiner*—John R. Miller

[57] ABSTRACT

A transparency is disclosed, which is suitable for use in a multi-colored xerographic reproduction process comprising a transparent, thermoplastic film sheet having at least one surface coated with a mixture consisting of a vinyl chloride-acetate copolymer resin and an acrylic resin in a weight ratio of between about 6:4 and 7:3. In a preferred embodiment, a percentage of a particulate material is also incorporated in the coating to reduce static charge on the transparency and permit easier handling thereof. The coated transparency, when used in a multi-colored electrostatic copying process improves adhesion of the multi-colored image thereon and permits reproduction of colors and colors densities in said image which correspond well to the multi-colored original copied.

4 Claims, No Drawings

TRANSPARENCY FOR MULTI-COLOR ELECTROSTATIC COPYING

BACKGROUND OF THE INVENTION

This invention relates to xerographic reproduction and specifically to transparencies which are suitable for use in a xerographic reproduction process.

Transparencies are a highly useful product in visual education since an image on a transparency may be projected with the necessary degree of magnification onto a screen where it may be viewed by a large number of persons. Transparencies have heretofore been made by photographic reproduction of the desired image and accordingly have required the skill of an individual who is familiar with complex photographic reproduction processes. Photographic reproduction of transparencies also requires the expenditure of a large amount of time and money and is thus undesirable for this reason. Therefore, an easy and inexpensive means for the production of transparencies has been sought whereby transparencies could be conveniently and economically imaged and then used an unlimited number of times in visual education programs.

The advent of xerography and electrostatic copying as generally disclosed by Carlson in U.S. Pat. No. 2,297,691 has proven to be a highly successful process for reproduction with the inherent advantages of speed and reliability. In a usual xerographic process, an electrostatic image of an object as formed on a recording member such as a xerographic plate or drum. The xerographic plate may comprise a layer of photoconductive material, such as selenium on a conductive metal backing. The latent electrostatic image which is formed on the photoconductive material is developed into a powder image which is then subsequently transferred to a sheet of paper and affixed thereon to form a permanent print.

The xerographic process has therefore proven to be an easy and reliable means for the production of transparencies. Transparencies made by a xerographic process are produced by forming an electrostatic image of the desired object, developing it, and then transferring it to a transparent sheet material with the image being permanently affixed or fused thereto by either the application of heat or by the action of a solvent vapor. In either case the toner which is used to develop the powdered image is coalesced on the sheet material by the fusing technique to form a permanent image thereon. Solvent fusion techniques, for transparent materials made by a xerographic process, for example, are illustrated in U.S. Pat. Nos. 3,049,810 and 3,148,078.

While the xerographic reproduction process is an apparent solution to the problem of economical and efficient production of transparencies, other problems have also been encountered with its use in the production of transparencies. One of the most pronounced problems with producing transparencies by an electrostatic copying process is to get the powdered or developed image to adhere well to a transparent film material before the image is permanently affixed thereto by fusing. Failure to achieve this results in partial or "cracked" images. A further problem encountered is obtaining proper and uniform density of the image after fixing or fusion and without resultant damage to the transparent film material either in the fusion process or in the transfer system employed within the machine. For this reason, various coating and combinations thereof with various types of transparent sheet materials have been previously proposed to obviate some of these difficulties. Included are various single component polymeric coatings such as are exemplified in U.S. Pat. Nos. 3,539,340; 3,539,341 and 3,535,112.

The above coatings, while of some assistance in improving adhesion of the developed electrostatic image to a transparent film material, nevertheless, are not entirely suitable when transparencies are produced by a multi-colored xerographic imaging process. The difficulties encountered with a multi-colored imaging process and transparencies produced thereby are due in part to the multi-component pigment developers required in the multi-colored imaging process and their varying degree of attraction for the transparent sheet material. Furthermore, the problem of getting the correct degree of coalescence of the toner particles in the permanent image is an even more critical matter with multi-colored imaging than with single color image development. This increased criticality is due to the fact that single color transparent images only require complete opaqueness or non-opaqueness of varying degrees to produce a transparency which has images suitable for projection.

Multi-colored transparency images, on the other hand, must allow for a certain degree of color density for each color or color combination in the image which is sufficient and uniform enough to allow projection of a uniform and true color. This, therefore, requires a different and unique combination of materials being employed and more critical controls being imposed upon the transparent materials which are used in a multi-color xerographic imaging process to obtain the correct degree of attraction of toner to the transparent sheet as well as proper coalescence of toner particles for good color density.

The instant invention relates to a transparency which fulfills all the requirements for use in the production of multi-colored electrophotographic images. The subject invention is particularly suited to overcome difficulties associated with the transfer step in the xerographic process. Many factors influence the quality of the transferred image, the most significant factors being those which effect the uniformity with which the toner powder image is transferred from the photoconductive surface to the sheet of support material. heretofore, in the process of transferring multi-layered toner powder images, as exemplified by a multi-color electrophotographic printing machine, the transfer of line copy has produced various problems. In particular, when a biased transfer roll is utilized to transfer successive toner powder images in superimposed registration to a sheet of support material, hollow characters frequently occur. Hollow characters may be defined as a toner area wherein substantially only the periphery thereof is transferred while the central portion remains devoid of toner particles. The problem of hollow characters is most pronounced for line copy reproductions; however, hollow characters frequently occur in solid area copy as well.

One approach to preparing multi-colored transparencies has been offered in copending applications Ser. Nos. 194,547 (filed on Nov. 1, 1971) now abandoned, 236,585 (filed on Mar. 21, 1972) now abandoned, and 321,511 (filed on Jan. 8, 1973) issued as U.S. Pat. No. 3,854,942. In these applications, a transparency comprising a thermoplastic film having a coating including a resin material, a wetting agent, and a particulate material is disclosed. While these transparencies function very effectively in most electrophotographic color copy machines, the nature of transfer subsystems in other color machines results in a color reproduction containing the above mentioned and undesirable hollow characters.

It is an object of the present invention, therefore, to provide for a transparency upon which a multi-colored xerographic image may be permanently affixed with uniform and consistent color reproduction and density.

It is also an object of the present invention to provide a transparency which is permanent in nature and having the sheet strength necessary to allow repeated use thereof for visual education purposes.

It is also an object of the present invention to provide for production of a color transparency by a xerographic multi-color imaging process which in turn eliminates the skill of a technician who is trained in reproduction photographic processing.

These and other objects, as well as the scope, nature and utilization of this invention will be apparent by the following detailed description and appended claims.

SUMMARY OF THE INVENTION

It has now been determined that the general objective of producing a transparency which will permanently hold a true and consistent multi-color xerographic image may be best achieved by utilizing a transparent, thermoplastic, film sheet such as a polysulfone or polycarbonate sheet material, followed by the coating of this sheet prior to xerographic imaging with a mixture of a vinyl chloride-acetate copolymer resin and an acrylic resin, such as a poly n-alkyl methacrylate. It is this coating composition which has been found to insure that all colored pigments required in the multi-colored reproduction process are properly attracted to and held by the transparent sheets during imaging and sheet transfer so that a permanent image having uniform and accurate color densities may be then fused on the transparent sheet. This coating overcomes the previously noted difficulties with producing a transparency by a multi-colored electrostatic copying process, among which are poor adherence of the developed xerographic image on the transparent film, as well as difficulty in insuring that a consistent and true color density is developed from the colored original which will also be suitable for projection or magnification on a screen. As indicated, these problems while existing with single color xerographic imaging, are even more pronounced when a multi-colored xerographic process is employed.

It has been further determined that if the coating mixture also includes a particulate material which is relatively inert, such as for example, asbestos, silica, colloidal silica and the like, the coated transparency is characterized by an exceptional reduction in its static properties to allow easy handling of the transparency through the frictonal paper handling system of the machine, as well as permit multiple sheet feeding through the machine without jamming or sticking therein. Sheets which are coated with a mixture containing an effective amount of a particulate material to reduce the static properties of the sheet also assist in toner transfer to the sheet during development, since if a high degree of static charge builds up on the sheet because of friction through the handling system, it can reduce the degree of attraction for the electroscopic toner particles used to develop the image and in fact may repel the toner particles thus preventing development of the image. The coating which also includes a particulate material therein, because of a reduction in static charge buildup, assists in toner transfer to transparent films.

DESCRIPTION OF THE PREFERRED EMBODIMENT

In the process of multi-colored xerographic reproduction, a subtractive color to color reproduction technique is used to develop images formed on the photoconductive layer. Furthermore, a multi-color xerographic imaging process may also employ multiple scanning of the colored original at different wavelengths of light to produce multiple images corresponding to each primary color involved in the original. These primary color images may be then recombined to form a single multicolored image corresponding to the original by using a multicomponent or multi-colored toner in a subtractive color to color reproduction process. A subtractive color to color reproduction process is illustrated in U.S. Pat. No. 3,057,720.

Toners which are employed in multi-color xerography use subtractive primary colors, yellow, cyan (blue green) and magenta. These in turn are used to reproduce a wide gamut of colors normally found in the colored original. For the purposes of illustration, when subtractive mixing of the yellow and cyan colorants take place, greens are obtained. Likewise, the mixing of magenta and yellow colorant in varying amounts reproduces reds, while combining the cyan with magenta results in the reproduction of blues. Mixtures of equal amounts of each toner, of course, will produce a black image.

Production of the multi-colored copy from the colored original may be appropriately achieved by any multi-colored xerographic imaging process. It is not intended that this invention be limited by particular variations in the multicolored xerographic imaging processes that might be employed or with the equipment used in said process. Nevertheless, for the purposes of illustration, a suitable process for color imaging begins with proper discernment of the color composition of the original subject matter and recording thereof. This may be conveniently accomplished by sequential optical scanning of the color original a number of times to formulate a sequence of the latent electrostatic images which correspond to the primary colors in the original. This is accomplished by the light image passing through an appropriate color filter so that the latent image is then in effect, color separated according to the various primary colors. Theorectically, the latent image which is formed by passing the light image through a green filter should require the magentas (the complementary color) as areas of relatively high charge density on the drum surface, while the green (the separated color) should cause a low-charged density level. The magentas are then made visible by applying a green absorbing magenta toner to the image bearing member. By the same token, a blue separation is developed with a cyan toner. The three developed color separations are then brought together in registration upon the final sheet of support material to produce a multi-colored facsimile of the original colored document copy.

It is this multi-component developer system used in a subtractive color to color reproduction process which presents numerous problems when, for example, a color transparency is produced thereby which will reproduce, with uniform and accurate consistency the color densities which correspond to the colored original.

In the production of transparencies by a multi-colored xerographic imaging process according to the present invention, a transparent, thermoplastic film sheet material is selected as the support material upon which the multi-colored xerographic image is to be developed. Although the sheet material may be any suitable thermoplastic film material which has the clearness, strength and heat resistance to allow repeated projection thereof, materials which are particularly preferred for the present invention include thermoplastic resins such as the polysulfones or polycarbonates.

Thermoplastic sheet material which may be conveniently utilized in the present invention includes polysulfone sheet material which are commercially available from Rowland Products Inc., Kensington, Connecticut and Instar Supply Co., Inc., New York, New York under the name Folacron PSN, as well as polycarbonate sheet materials commercially available from General Electric Corp., Waterford, New York under the name Lexan SL 1007. These materials may be selected from any thickness range desired, although in selecting film thickness, the films should be thick enough to have the necessary strength but still be thin enough to remain flexible throughout continuous use thereof. A suitable thickness of the film suitable for use in xerographic imaging, will generally be 3 to 8 mils.

The thermoplastic film material is then coated with a mixed, polymeric coating composition which has been found to significantly improve adhesion of a multi-colored xerographic image to a transparency during the xerographic development process while at the same time during image fusion, permitting accurate reproduction of color density on the transparency. The coating in this regard has been found to assist in permanent fixing or fusing of the developed image to the transparency by either solvent vapor or heat fusion techniques, although solvent vapor fusion is preferred as the method of fusion for transparencies produced according to the present invention.

In a preferred embodiment of the present invention, it has also been determined that if the coating contains a relatively inert particulate material, a transparency is provided which is characterized by an exceptional reduction in its static properties, permitting easier handling thereof as well as permitting multiple sheet feeding of the sheets through the paper handling system without feeding problems from the paper feeding tray.

The coating developed herein comprises a mixture of a vinyl chloride-acetate copolymer resin and an acrylic resin such as a poly n-alkyl methacrylate and, as a preferred embodiment, incorporation of a relatively inert particulate material. This coating mixture will be normally applied to the transparent film material in the form of a solution and because of this, the choice of solvents to provide the solution is important, relative to the coating composition, since it must not cloud or change the film material and it must at the same time provide enough solubility for the coating composition to provide a clear uniform coating on the transparency with no evidence of component insolubility. It will, of course, be understood that when a coating mixture is employed which contains a relatively inert particulate material, the latter will ordinarily be insoluble, being in suspension in the solution of the other components of the coating mixture.

The solvent composition found to be suitable for use with the present composition and for its application to transparencies produced therewith is a mixture of 2-ethoxy ethanol and a ketone, preferably methyl isobutyl ketone. The mixture of these solvents which is used to dissolve the coating composition of the present invention will preferably comprise between about 2.5 to 3.0 parts of 2-ethoxy to 1 part of the ketone, although variations in the amount of these solvents may be made depending on the specific materials employed out of the group that will work.

The proper amounts of the coating composition are then added to the aforementioned solvent mixture and dissolved. The preferred amounts of materials utilized in the coating composition of the present invention include a ratio of the acrylic resin to the vinyl chloride-acetate copolymer resin of between about 6:4 and 7:3 by weight of the mixture. If the ratio of these two ingredients falls above this range, an undesirable tackiness would result with the coating, while if the ratio falls below this range, poor image adhesion results.

In the preferred embodiment of the present invention, a particulate material is included in the coating composition in an amount of between about 1 and 20% by weight of the polymeric components of the mixture, i.e., the acrylic and vinyl chloride-acetate copolymer resin. This particular percentage range has been found to be the most effective means for reducing static charge buildup on the transparent sheet through the paper handling system of the machine under varying conditions of relative humidity. Obviously, since the degree of static charge buildup will be somewhat dependent on the relative humidity of the environment, the percentage of particulate material may be varied over a wider range depending on the amount that is needed to reduce the static charge to an acceptable level without a deleterious effect on the transparency of the sheet.

The particulate material which is added to the coating for reduction of the static charge on the transparent sheet under handling conditions; adds a degree of "bulk" to the coating and due to its protrusion through the coating imparts a certain degree of roughness or texturing on the transparency surface, even though this texturing may not be readily discernible to the unaided eye. This texturing or roughness succeeds in reducing the static charge buildup on the transparency surface during handling by frictional contact by reducing the surface area of the sheet which is in contact with other frictional surfaces in the sheet handling system of the machine, since contact with the sheet surface occurs only through the particulate material. This minimal surficial contact will result in a sheet which exhibits little static buildup during handling, development and transfer and permits easy machine feeding thereof.

It is therefore, the proper combination of these components which is critical for proper fixing and adhesion of the multi-colored xerographic image to the transparency. It is also this combination of ingredients which allows correct reproduction of color density in the fused image, as well as giving strength to the film which is needed for sheet transfer during copying and continuous use of the transparency after formation. The ingredients used must also be compatible with the multi-component toners used for the subtractive color reproduction processes and accordingly prevent precipitation or deposition of the toner as discrete, recognizable, particles in the final developed image as opposed to coalescence and formation of a uniform and consistent toner film. If the toner is deposited as recognizable and discrete particles, then an image is produced which has a "dirty" or spotty look and the color density thus becomes eratic. The coating materials must therefore be comparable with the toner materials used to develop the multi-color images, while at the same time being transparent and yet strong enough to permit normal handling of transparencies.

The vinyl chloride-acetate copolymer resin material which may be used in the coating composition of the present invention may be any commercially available form of this material. Suitable for use, for example, is that copolymer material manufactured by Union Carbide Corp., including Bakelite VMCH. The vinyl chloride-acetate copolymer resin material imparts the necessary toughness to the film and the image which is produced thereon to prevent scratching of the image or the film besides also preventing excessive curling of the transparency after subsequent fusion techniques.

The acrylic resin is added to and improves adhesion and fixing of the toner and may be conveniently selected from among the various poly n-alkyl acrylic resins such as the polymerized n-alkyl methacrylates which are commercially available from E. I. duPont deNemours and Co. and available under the trade name of Lucite. Although various alkylated methacrylates will be suitable for use in the present invention, nevertheless, the butyl methacrylates such as Lucite 44, 45 and 46 are preferred for use in the present coating composition.

In the preferred embodiment of the present invention, the particulate material which is added to the coating to texturize the surface of the transparency may be selected for a group of relatively inert, particulate materials including asbestos, silica, or colloidal silica and can be conveniently added to the coating during dissolution of the polymeric materials. As previously noted, a preferred range for addition is between about 1 to 20% by weight of the mixture of polymeric components which comprise the vinyl chloride-acetate copolymer resin and acrylic resins. This range of addition allows for a sufficient degree of reduction of static charge on the sheet under varying conditions of relative humidity to permit easy handling and multiple sheet feeding without having a deleterious effect on the clearness or transparency of the thermoplastic film. It should be recognized however, that the particulate material could be employed outside of this range dependent on the ambient conditions the sheet might be used under as long an acceptable decrease in static properties of the sheet occurs without affecting the transparency of the film sheet. Transmission measurements made over the wavelength region of active light on transparencies containing the particulate material indicate substantially the same transmission is obtained with the uncoated sheet as with the coated sheet containing the particulate material.

The coating composition after dissolution in the appropriate solvent mixture is applied to the transparent thermoplastic film by techniques which are well known to those skilled in the art of paper coating. Various techniques which are suitable for coating could be by roll, air knife, or any other uniform application means used in paper coating. For instance, the coating may be simply passed through a hopper containing the coating composition in liquid form, which is provided by a doctor blade or the coating may be applied by use of a more precise coating apparatus such as a gravure press. Preferably a coating of between about 0.1 and 0.7 mils thickness is produced upon the transparent thermoplastic film sheet after evaporaton of a solvent or solidification of the dissolved polymeric materials. Since the polymeric coating on the sheet is in the nature of an extremely thin film, no significant impairment of the transparency of the sheet itself results from its presence and the transparency formed therefrom by electrostatic image, processes the requisite degree of clearness to be satisfactory for most visual education purposes.

The following is giving a specific illustration of the present invention although it should be understood that the invention is not intended to be limited to specific details to be set forth thereon.

EXAMPLE 1

A transparent, thermoplastic film material with dimensions of 8½× 11 inches consisting of a polysulfone transparent sheet having a thickness of 5 mils was used as the substrate for a coating composition which was prepared by forming a solution of 60 parts of 2-ethoxyethanol, and 20 parts of methyl isobutyl ketone, followed by the addition thereto of:

7 g. n-butyl methacrylate
3 g. vinyl chloride-acetate copolymer resin
(86% vinyl chloride, 13% vinyl acetate)

This was mixed until a clear solution was obtained followed by the application of the coating composition to the polysulfone sheet with a No. 20 Mayer Rod, followed by drying of the coated sheet with warm air. After evaporation of the solvents used in applying the coating, a coating thickness of about 0.3 mils was obtained.

The coated transparent sheet material was subjected to a multi-colored xerographic imaging process with resultant vapor fusion of the adherent multicolor image. It was observed that superior image adhesion occurred both before and after vapor fusion and more toner transfer was obtained with a highly uniform and accurate colored image being formed. The colors reproduced were uniform, with consistent color density and with no evidence of toner "spotting". Additionally, the multi-colored transparencies exhibited low frictional and static properties when compared with uncoated transparencies.

EXAMPLE 2

Three transparent polysulfone sheet materials as in Example 1 were coated according to the procedure of Example 1 and were designated as sheets A, B, and C. The sample designations corresponded to the following formulations used to prepare the coating used for each sheet.

SAMPLE A 8 g. n-butyl methacrylate
2 g. vinyl chloride-acetate copolymer resin
(86% vinyl chloride, 13% vinyl acetate)
dissolved in a mixture of 45 parts of 2-ethoxyethanol and 15 parts of methyl isobutyl ketone.

SAMPLE B 5 g. n-butyl methacrylate 5 g. vinyl chloride-acetate copolymer resin
(86% vinyl chloride, 13% vinyl acetate)
dissolved in a mixture of 45 parts of 2-ethoxy-ethanol and 15 parts of methyl isobutyl ketone.

SAMPLE C 2 g. n-butyl methacrylate
8 g. vinyl chloride-acetate copolymer resin
(86% vinyl chloride, 13% vinyl acetate)
disslved in a mixture of 45 parts of 2-ethoxy-ethanol and 15 parts of methyl isobutyl ketone.

Each coated sheet was subjected to a multi-colored xerographic imaging process, with resultant examination of the quality of the image on the transparent sheet material.

Sample A was observed to have good image quality with good color density and uniformity although the coating had an undesirable tackiness.

Sample B and C were observed to have good image quality with good density and uniformity although adhesion of the image before and after vapor fusion was poor.

EXAMPLE 3

A thermoplastic film sheet having approximate dimensions of 8½ × 11 inches consiting of polysulfone material and with a thickness of 5 mils is used as substrate for the following coating specification:
7 g. n-butyl methacrylate
3 g. vinyl chloride-acetate copolymer resin
(86% vinyl chloride, 13% vinyl acetate)
2 g. asbestos The coating formulation is prepared by forming a solution of 60 parts of 2-ethoxyethanol and 20 parts of methyl isobutyl ketone and the components dissolved in the solvent mixture followed by application to the polysulfone sheet with a No. 20 Mayer Rod. The coated sheet is subsequently dried with a current of warm air, and after evaporation of the solvent used in applying the coating, a coating thickness of about 0.3 mils is obtained.

After coating and drying, the sheet is subjected to a feeding test in a multi-colored electrostatic copier to evaluate machine feed capability. Further, the static and kinetic coefficient of friction is measured against itself according to ASTM procedure D1894-63, entitled *Standard Method of Test For Coefficients of Friction of Plastic Film* and compared against uncoated polycarbonate and polysulfone sheets as well as the coated sheet of Example 1. The static or starting coefficient of friction expressed is related to the force measured to begin movement of the surfaces of the two sheets relative to each other, while the kinetic or sliding coefficient of friction expressed is related to the force measured in sustaining this movement. The transmission of the polysulfone control and the instantly prepared sheet was also measured at varius wavelengths of actinic light.

It may be seen from the data set forth that the transparency which is coated with the instant coating composition which additionally contained a particulate material such as asbestos or silica, exhibits improved machine feeding properties and better coefficients of friction than the controls and the coated sheet which did not contain a particulate material.

Although the invention has been described both various embodiments, it is understood that variations and modifications may be made as will be apparent to those skilled in the art. Such reasonable variations and modifications are furthermore considered to be within the spirit and scope of the claims appended hereto.

| | Polysulfone Sheet (uncoated) Control | Polycarbonate Sheet (uncoated) Control | Example 1 Sheet (Resin Coating Alone) | Example 3 Sheet (Resin + Particulate Material Coating) |
|---|---|---|---|---|
| 1. Machine Feed Characteristics | Won't Feed | Won't Feed | Won't Feed | Good |
| 2. % Transmission | | | | |
| 420 mu. | 87% | | 88.3 | 87.0 |
| 560 mu. | 90% | | 89.7 | 89.0 |
| 700 mu. | 92% | | 90.1 | 89.8 |
| 3. Coefficients of Friction (static coefficient of friction/kinetic coefficient of friction) | >1.0 | .50/.44 | >1.0 | 0.60/0.52 |

What is claimed is:

1. A transparency for the formation of an adherent, multi-colored electrostatic image thereon comprising a thermoplastic film sheet, said sheet having at least one surface coated with a mixture which consists essentially of an acrylic resin and a vinyl chloride-acetate copolymer resin in a weight ratio of between about 6:4 and 7:3 and a relatively inert particulate material in an amount of between about 1 to 20% by weight of said resins to reduce the static properties of said sheet.

2. A transparency as set forth in claim 1 wherein said particulate material is asbestos, silica or colloidal silica.

3. A transparency as set forth in claim 1 wherein said thermoplastic film sheet is polysulfone or polycarbonate.

4. A transparency as set forth in claim 1 wherein said coating on said sheet has a thickness of between about 0.1 and 0.7 mils.

* * * * *